US005987721A

United States Patent [19]

Morris

[11] Patent Number: 5,987,721

[45] Date of Patent: Nov. 23, 1999

[54] IMPARTING STRETCH TO FABRICS

[76] Inventor: David Eric Morris, Larkrise Cragg Wood Drive, Rawdon, Leeds LS19 6LG, United Kingdom

[21] Appl. No.: 08/556,915

[22] PCT Filed: May 19, 1994

[86] PCT No.: PCT/GB94/01079

§ 371 Date: Aug. 28, 1997

§ 102(e) Date: Aug. 28, 1997

[87] PCT Pub. No.: WO94/28227

PCT Pub. Date: Dec. 8, 1994

[30] Foreign Application Priority Data

May 21, 1993 [GB] United Kingdom ..... 9310707
May 21, 1993 [GB] United Kingdom ..... 9321124

[51] Int. Cl.[6] ..... D03D 7/00

[52] U.S. Cl. ..... 28/155; 28/156; 28/166

[58] Field of Search ..... 26/18.5, 18.6; 28/134, 137, 138, 155, 156, 158, 166, 151

[56] References Cited

U.S. PATENT DOCUMENTS

| | | | |
|---|---|---|---|
| 2,319,809 | 5/1943 | Francis, Jr. | 26/18.6 |
| 2,573,773 | 11/1951 | Rowe | 28/155 |
| 3,100,925 | 8/1963 | Messinger | 26/18.6 |
| 3,290,209 | 12/1966 | Ihrman | 26/18.6 |
| 3,382,552 | 5/1968 | Davis et al. . | |
| 3,504,712 | 4/1970 | Dusenbury et al. . | |
| 3,570,085 | 3/1971 | Heinemann | 26/18.6 |
| 3,589,030 | 6/1971 | Troope | 26/18.6 |
| 3,655,474 | 4/1972 | Constantine | 26/18.6 |
| 3,723,217 | 3/1973 | Bauer | 28/155 |
| 3,723,993 | 4/1973 | Ruby | 2/237 |
| 3,867,248 | 2/1975 | Bauer | 26/18.6 |
| 4,033,783 | 7/1977 | Groome et al. | 26/18.6 |
| 4,051,215 | 9/1977 | Tsuruta et al. | 28/155 |

FOREIGN PATENT DOCUMENTS

| | | |
|---|---|---|
| 24 44 923 | 4/1976 | Germany . |
| 2 256 785 | 12/1992 | United Kingdom . |

*Primary Examiner*—Amy Vanatta
*Attorney, Agent, or Firm*—Kohn & Associates

[57] ABSTRACT

A method of treating a woven fabric, this method including applying simultaneous and progressive heat and pressure to the fabric in such a manner that the yarn strands substantially across the width of the fabric are forced closer together thus imparting generally semi-permanent ease or stretch into the fabric, which is characterized and the method also includes affixing to the fabrics treated a selected interlining or interlining combination having inherent stretch whereby the semi-permanent ease or stretch imparted to the fabric is made substantially permanent is provided. Also provided is a fabric treatment apparatus having a heat applicator and pressure to a woven fabric and a transporter for affecting relative movement between the heat and pressure applicator and a fabric whereby passage of the fabric through the apparatus results in the yarn strands substantially across the width of the fabric being forced closer together thus imparting semi-permanent ease or stretch into the fabric, characterized and that the apparatus also includes means for affixing to the treated fabric an interlining and/or interlining combination having inherent stretch whereby the semi-permanent ease or stretch imparted to the fabric is made substantially permanent.

15 Claims, 7 Drawing Sheets

(i)

(ii)

IMPARTING STRETCH TO FABRICS

The present invention relates to a process for treating fabric and to a fabric construction system, particularly though not exclusively, for application in clothing manufacture, which enables a certain degree and type of stretch to be imparted into, for example, a waistband, which hitherto has not been achieved.

Conventionally, waistband interlining can be elasticated and the outer fabric of the waistband ruched or gathered, providing for a large degree of stretch whilst compromising the tailored look and fit of the garment to which such an elasticated waistband is attached; or comprises a non-stretch interlining which acts as a stiffener stabilzing the outer fabric, affording some degree of reinforcement and perhaps providing added resilience.

The disadvantage of the latter system of construction is that there is little give or ease in that area of the garment incorporating the waistband, and the fit of the garment may become uncomfortable to the wearer, for example after meals when the waist expands; in prolonged wear the top of the waistband can be forced to give way and effectively roll over rendering the look of the garment unsightly. In addition a wearer falling mid way between sizing of off the peg waistbanded garments selects a garment which is either too tight or too loose in normal wear.

Relatively recently waistbands incorporating a combination of interlinings, linings and outer fabrics, although not necessarily all three components, which have inherent give or ease and provide a degree of stretch have been produced and sold in trousers and skirts. Waistbands incorporating stretch fabrics for example those containing Lycra or Elastane, and/or those referred to as weft stretch, in some cases achieve a satisfactory level of comfort.

The present invention is therefore concerned primarily with consistently achieving ease and comfort using conventional non-stretch outer fabrics, for example those where the inherent characteristic in the length or width of the material does not have a sufficient degree of ease or stretch to enable a stretch waistband to be produced with conventional methods. Some examples of such fabrics include woven or knitted combinations of polyester/wool, polyester/viscose, cotton etc.

U.S. Pat. No. 4,051,215 discloses a method of applying heat and pressure to a woven fabric to impart elasticity in its warp direction, which includes the use of a cellulose reactive resin solution. German Patent Specification No. 2444923 discloses affixing an interlining to a fabric, in particular stitching a stiffening strip to a wider facing strip.

According to a first aspect of the present invention there i s provided a method of treating a woven fabric, the method including applying heat and pressure to the fabric in such a manner that the yarn strands substantially across the width of the fabric are forced closer together thus imparting generally semi-permanent or permanent ease or stretch into the fabric.

It is intended that the fabric so treated would be an outer fabric, but the process can also be applied to lining or interlining fabrics.

The fabric treated may be in full width form, but typically the fabric (e.g. an outer fabric) is cut into strips either down the length of the piece (i.e. in the warp direction—where continuous strips may be used) or at right angles across the piece (i.e. in the weft direction). This provides the classic tailored look in the finished waistband. If it is desired to achieve a higher degree of stretch the fabric may be cut at a predetermined angler to the warp or weft direction which will create additional ease in the strip dependent on the angle of bias selected, but will compromise the traditional look and would be unacceptable in fabrics with a check pattern for example.

Naturally, if the strips are cut at right angles across the piece (i.e in the weft direction), the reference made herein to the strands substantially across the width of the fabric should be interpreted as meaning the strands substantially across the width of the strip.

The strips may be discrete strips or may be continuous strips or reels of fabric, the latter option permitting higher process efficiency to be achieved although this is not always practical from a design viewpoint or necessarily cost effective in cloth utilization terms.

Typically the outer fabric strip, having had imparted thereto generally semi-permanent or permanent ease or stretch in accordance with the method of the present invention, has affixed thereto, for example by fusing with adhesive, a selected interlining and/or interlining combination which has the inherent stretch required. Interlining selections could include elastic types where the degree of stretch is known as well as the recovery performance during prolonged wear.

The interlining/s may be woven, woven biased; knitted; non-woven; web adhesives or any other suitable material which, when fused, will maintain the stretch and recovery properties imparted to the outer fabric during the treatment of the present invention. In some cases the treatment stage is sufficient in itself to enable stretch to be imparted and retained without the need for interlining attachment in the construction.

Where an interlining is affixed to the treated outer fabric, the fused strip may optionally be further processed, for example it may be fed through an overlock machine to eventually provide for a curtain finish or be sewn to a pre-formed stretch/bias lining or lining composite.

A lining composite may be manufactured according to the present invention by subjecting a non-stretch lining fabric, for example woven polyester/cotton to the heat and pressure treatment specifed as being in accordance with the first aspect of the invention, whereby stretch is imparted to the lining fabric. A suitable interlining fabric is fused to the pretreated lining fabric, the interlining fabric being such that, when fused, it will maintain the stretch and recovery properties of the lining fabric imparted by the treatment of the present invention. This provides a lining composite which has the desired stretch characteristic—this process has the advantage of avoiding bias sewing costs involved in conventional lining composite production and enables a wider range of fabrics to be utilized in the lining of trousers or skirts. Typically the lining fabric would be in the form of a continuous reel, to provide a continuous lining composite.

The method of the present invention may conveniently be carried out by machine, and according to the second aspect of the present invention there is provided fabric treatment apparatus comprising means for applying heat and pressure to a woven fabric and transport means for effecting relative movement between said heat and pressure application means and said fabric whereby passage of the fabric through the apparatus results in the yarn strands substantially across the width of the fabric being forced closer together thus imparting semi-permanent or permanent ease or stretch into the fabric.

The apparatus preferably includes means for handling continuous reels of fabric (if used). In the case of continuous reels an operator would be required to load the reels, whereas with individual strips an operator is required to locate each individual strip in a similar type operation to the placement of strips in a conventional waistband fusing operation.

Typically, the apparatus comprises a rubberized conveyor belt in close proximity to a heated steel roller, the strip passing along the belt and being nipped under the roller where both pressure and heat is applied progressively to the whole of the length of the strip or reel as the fabric progresses through the apparatus.

Preferably, the settings for the temperature and pressure of the steel roller, and the speed of the rubberized conveyor belt are pre-selected for one particular run or series of runs, but some or all of these settings can be variable dependant upon the degree of stretch required and the nature or composition of the material being processed. The apparatus preferably includes means for optional steaming, water mist or similar damping of the fabric prior to the nip to aid the process. During the process the yarn strands disposed at right angles to the direction of the rubber conveyor or at least substantially across the width of the strip are forced closer together. The extent to which the closing up occurs for example may be dependant upon machine settings, hygral conditions, inherent thermal yarn shrinkage, the set of the fabric, etc.

On exiting from this apparatus the fabric strip has been treated in such a way as to impart generally semi-permanent or ease or stretch into the fabric.

Where the apparatus is used to treat strips of outer fabric or lining fabric, the apparatus preferably encompasses means for fusing interlining/s to the treated fabric. This may be either in line with the main apparatus or integral therewith, or alternatively the treated strip may be fused with interlining/s by passage through a conventional waistband fusing system.

According to a third aspect of the present invention there is provided a woven fabric having ease or stretch imparted thereto by the method of the first aspect of the present invention.

According to a fourth aspect of the present invention there is provided a waistband incorporating outer fabric and/or lining fabric and/or interlining fabric treated in accordance with the first aspect of the present invention.

Whilst the fabric or fabric composite produced in accordance with the present invention having stretch potential is primarily intended to be incorporated in a waistband around the waists of garments such as trousers or skirts, the product could also be utilized for any other part of a garment where its benefits would be advantageous, for example to provide ease around cuffs, pocket mouths, trouser bottoms, sleeve heads etc. It could also have wider applications to textile articles other than garments, where stiffening or reinforcing with a certain degree of stretch is required.

Many other applications are also envisaged, for example tapes produced for seam sealing in, for example, the manufacture of waterproof outergarments. Conventionally, tapes for this purpose have to be cut on the bias in order to have sufficient stretch, whereas using a tape made from fabric treated according to the present invention has stretch or ease built in and therefore removes the need for biasing.

Embodiments of the present invention will now be described, by way of example only, with reference to the accompanying drawings, in which.

Figure 1:
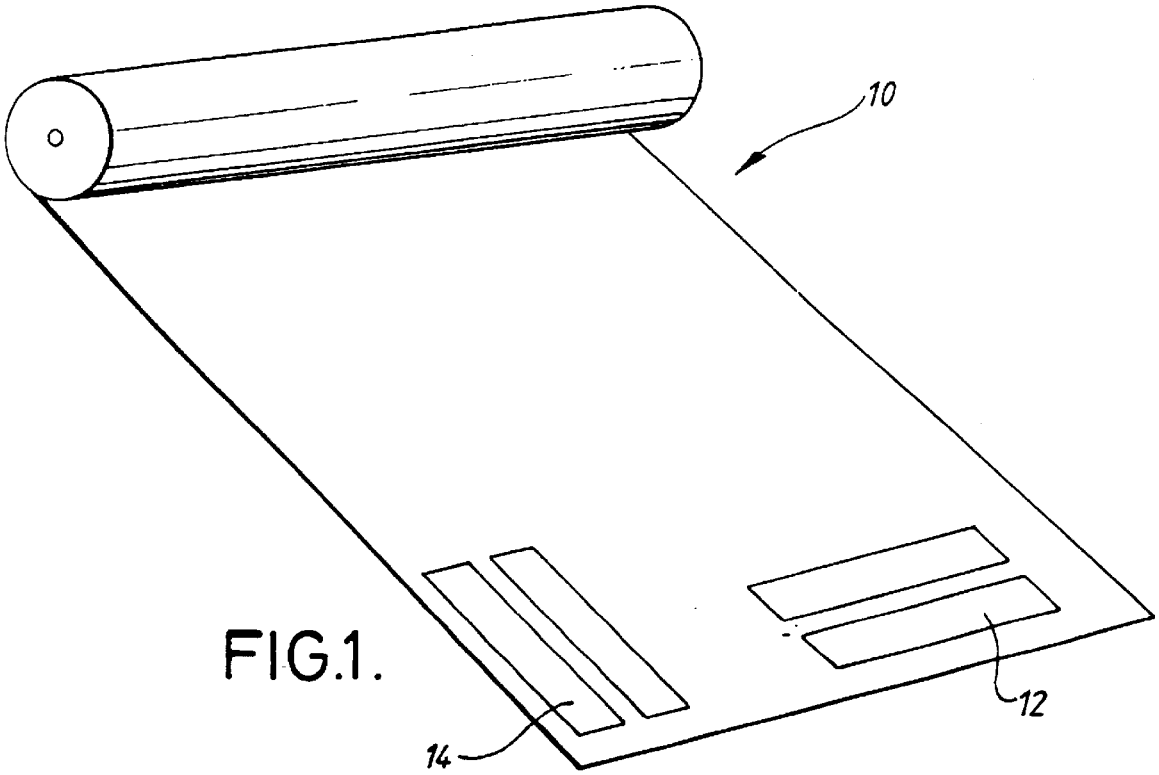
FIG. 1 illustrates the preparation of outer fabric strips.
Figure 1A:
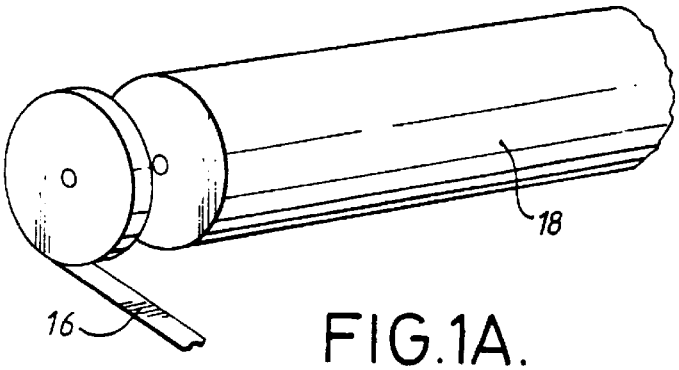
FIG. 1A illustrates an alternative preparation of the outer fabric strips.

Referring to FIG. 1 an outer fabric 10 is cut into strips 12, 14 either across the fabric (12) or down the length of the fabric (14). Alternatively, in FIG. 1A, a continuous strip or reel 16 is cut down the length of the fabric, from the roll 18. The fabric may alternatively be treated in the full width form.

Figure 2:
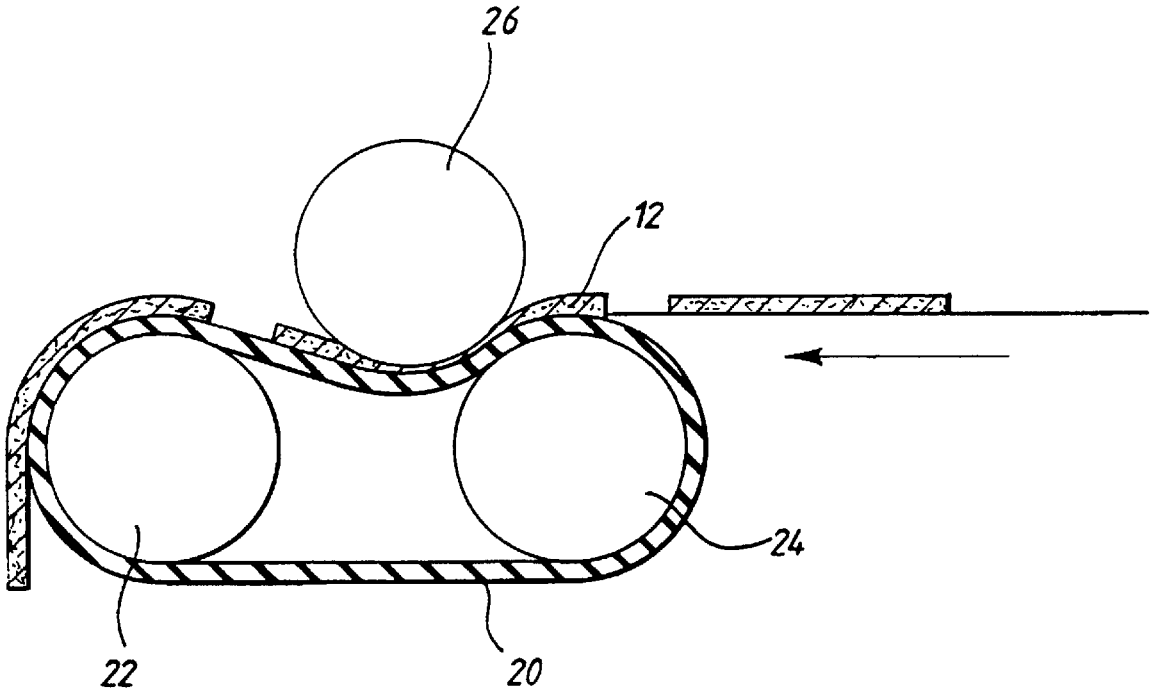
FIG. 2 is a schematic drawing of the machine process.

As can be seen in FIG. 2, the apparatus according to the invention comprises a rubberized conveyor belt 20 driven by conveyor rollers 22, 24, and a heated roller 26 which is held against the belt 20 in closed proximity to roller 24, so as to apply heat and pressure to a fabric strip 12 passing through the nip formed between rollers 26 and 24. The strips are placed onto the conveyor by the operator—the fabric strip direction being at right angles to the heated roller. The strip is progressed through the nip of the roller and rubberized conveyor.

Figure 3:
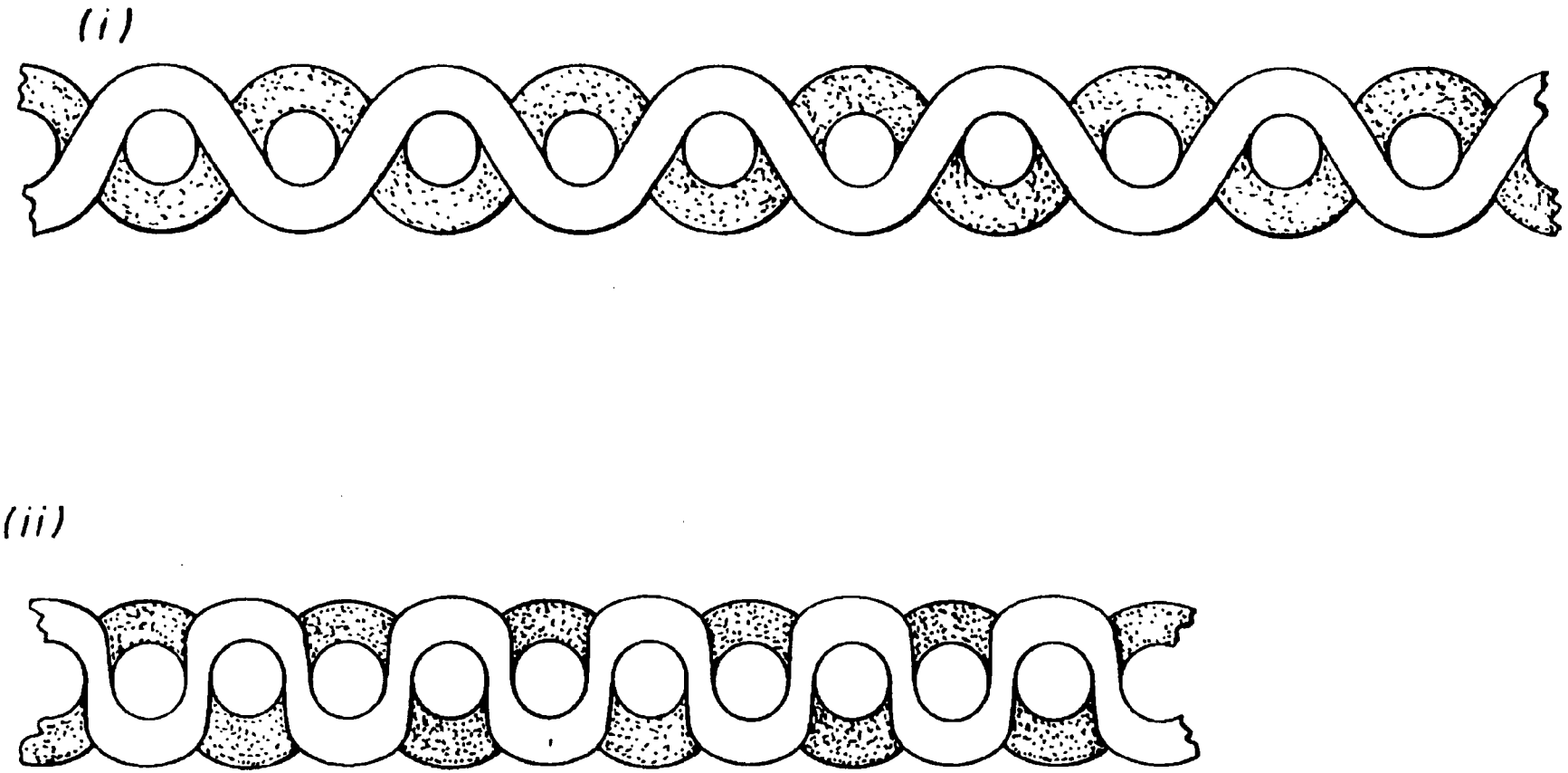
FIG. 3 illustrates strands drawing closer together.

The result of this treatment is to force the strands which pass substantially across the width of the strip to draw closer together, as shown in FIG. 3 (FIG. 3(i) is before treatment, FIG. 3(ii) is after treatment).

Figure 4:
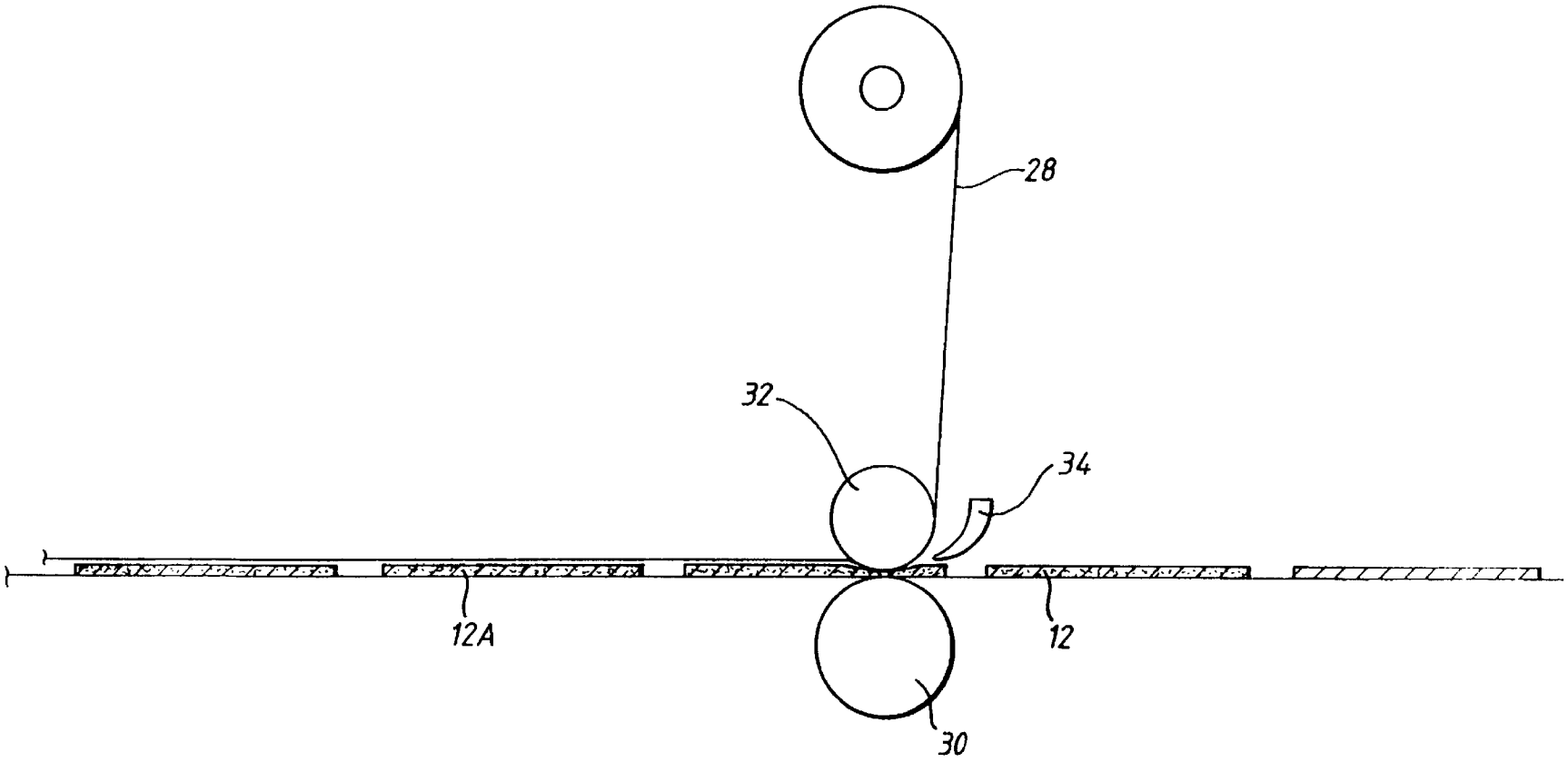
FIG. 4 illustrates interlining/s being fused to the strips.

As shown in FIG. 4, fusible interlining 28 is introduced and fused to the treated outer fabric strips 12—this operation can be performed in-line with the apparatus shown in FIG. 2, using a hot air applicator 34 which directs hot air into the nip between two rollers 32, 30. The result is a strip 12A which comprises a treated outer fabric strip 12 fused with interlining 28. One particularly suitable fusible interlining is reference number 010 LC from Lainiere de Picardie. Alternatively, a conventional waistband fusing system can be utilized to carry out this step.

Figure 5:
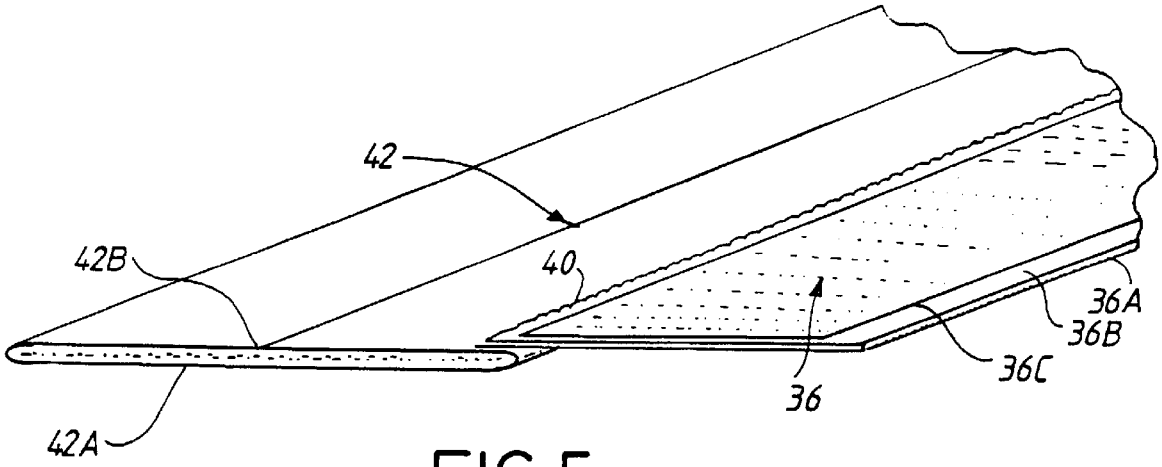
FIGS. 5 & 6 illustrate respectively the construction of a lined waistband and its attachment to a garment.
Figure 6:
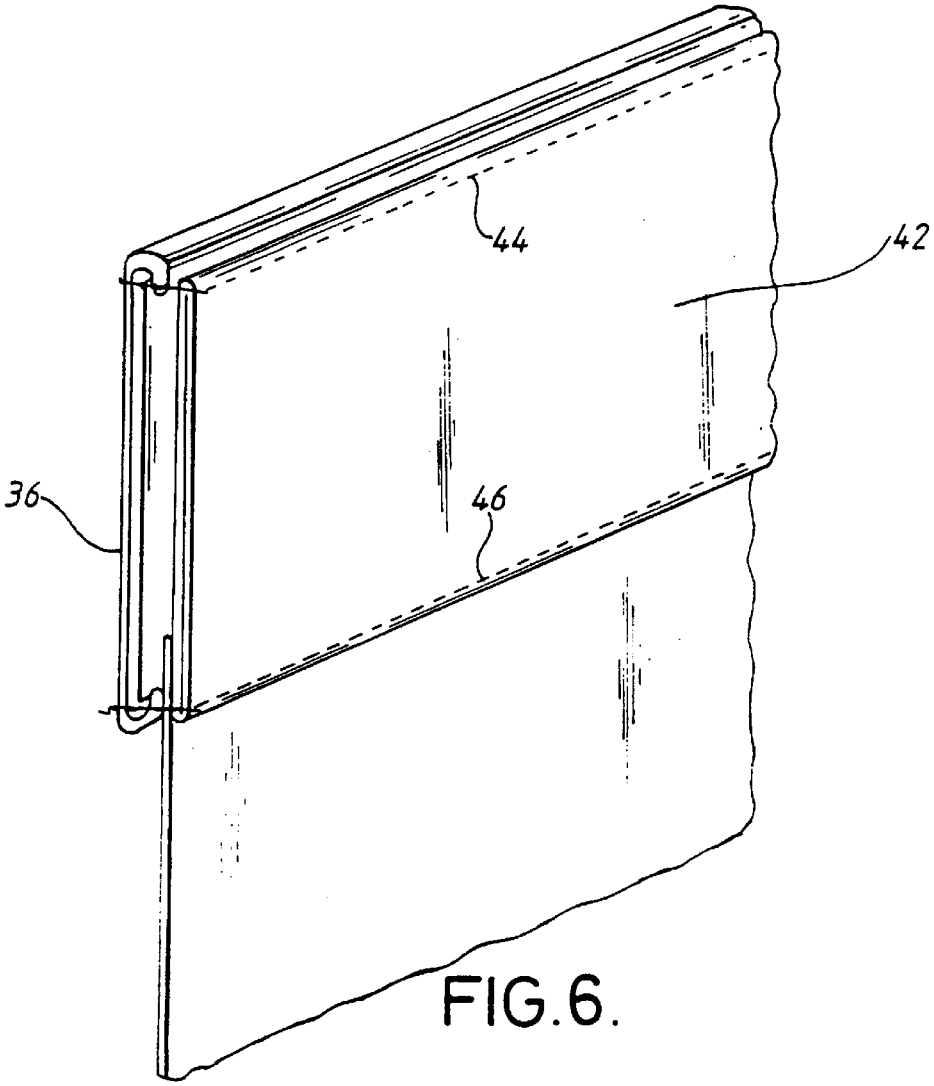

Referring to FIG. 5, a lined waistband may be created when the outer fabric fused composite 36 at least part of which has been treated according to the present invention and comprising an outer fabric 36A, a fusible carrier 36B and a stiffener 36C is sewn along sewing line 40 to a lining or lining composite 42 comprising a lining fabric 42A and a fusible interlining 42B (the lining is generally supplied in a continuous reel form to the clothing manufacturer). The outer fabric fused composite 36 may then be folded along the edge of the stiffener 36C or along slots provided in the carrier thereby setting the lining or lining composite back from the edge of the made up waistband, as illustrated in FIG. 6. The assembly is then stitched together along sewing lines 44, 46.

Figure 7:
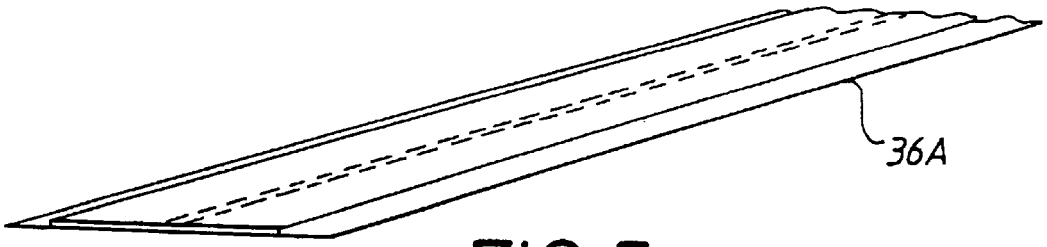
FIGS. 7 & 8 illustrate respectively the construction of a cloth waistband and its attachment to a garment.
Figure 8:
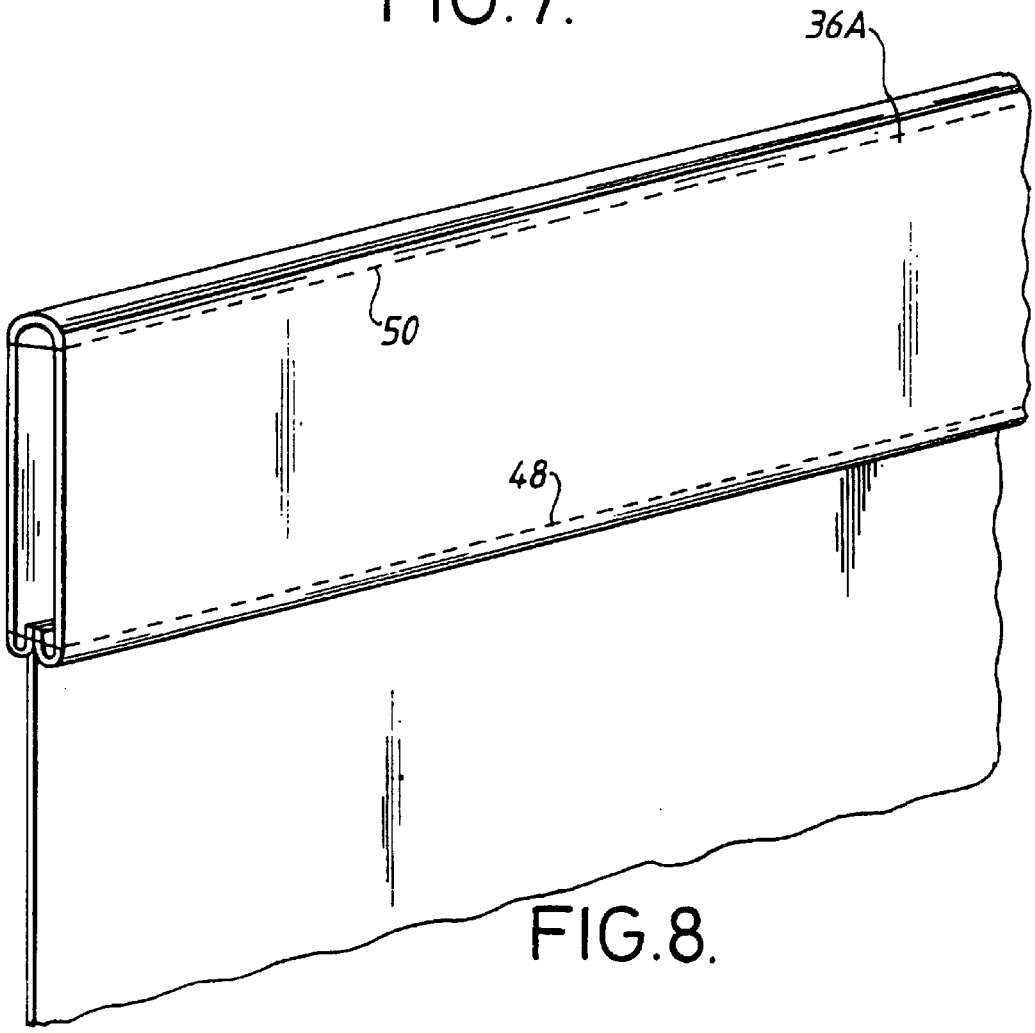

Referring to FIGS. 7 & 8, a cloth waistband may be created by folding the outer fabric fused composite 36, at least one of the components of which has been treated in accordance with the present invention, in half, either along the edge of the stiffener (if one has been used) or by folding along the slots in the fusible interlining (if provided); the unfinished edges are folded under and attached to the outer and inner sides of the garment as shown in FIG. 8, being secured along sewing lines 48, 50.

Figure 9:
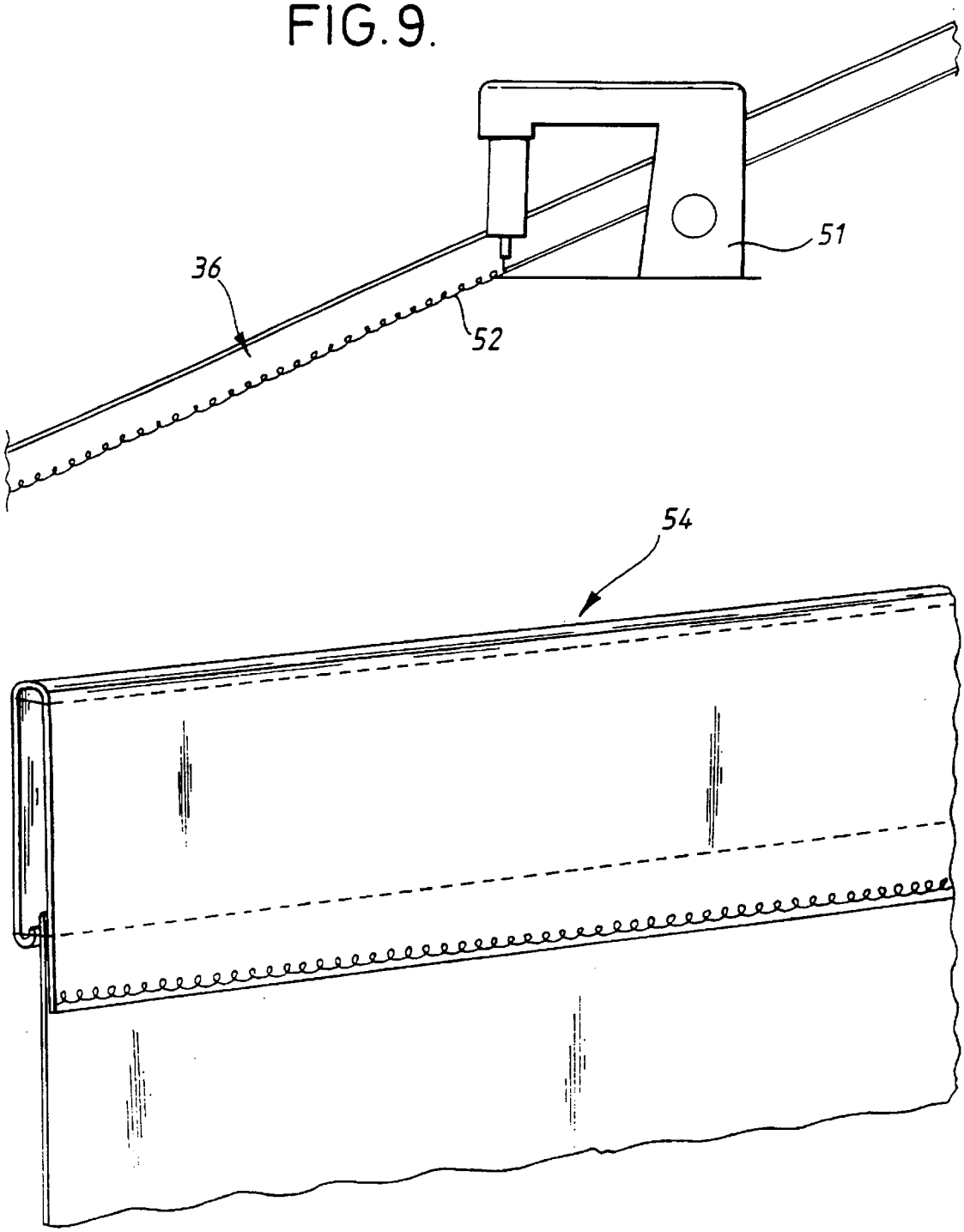
FIG. 9 illustrates the bottom of the outer fabric composite being overlooked to eventually provide a curtain finish.

Optionally, the outer fabric fused composite 36 can be overlooked along one edge 52 by an overlock sewing machine as shown in FIG. 9, to provide a curtain finish to the cloth waistband 54.

I claim:

1. A method of treating a woven fabric, containing yard strands so as to impart permanent stretch without ruching, the method including applying simultaneous and progressive heat and pressure to the fabric in such a manner that the yarn strands substantially across the width of the fabric are forced closer together thus imparting generally semi-permanent ease or stretch into the fabric, characterized in that the method also includes affixing to the fabric so treated a selected interlining and/or interlining combination having inherent stretch whereby the semi-permanent ease or stretch imparted to the fabric is made substantially permanent.

2. A method according to claim 1 further including cutting the fabric to be treated into strips either down the length of the fabric or at right angles across the piece.

3. A method according to claim 2 wherein the strips are either discrete strips or continuous strips or reels of fabric.

4. A method according to claim 1 wherein the interlining is selected from elastic types of interlining thereby maintaining the stretch in the interlining.

5. A method according to claim 1, further including processing the treated fabric by feeding the treated fabric through an overlock machine.

6. A method according to claim 1 further including showing the treated fabric to a pre-formed stretch/bias lining or lining composite.

7. A method according to claim 6 further including the by subjecting a non-stretch lining fabric of the lining composite to the heat and pressure treatment according to claim 1 whereby stretch is imparted to the lining fabric, and then fusing this to a suitable interlining fabric, which, when fused, will maintain the stretch and recovery properties of the lining fabric imparted during the treatment according to claim 1, thus providing a lining composite which has the desired stretch characteristic.

8. Fabric treatment apparatus comprising means for applying heat and pressure to a woven fabric and transport means for effecting relative movement between said heat and pressure application means and said fabric whereby passage of the fabric through the apparatus results in the yarn strands substantially across the width of the fabric being forced closer together thus imparting semi-permanent ease or stretch into the fabric, characterised in that the apparatus also includes means for affixing to the treated fabric an interlining and/or interlining combination having inherent stretch whereby the semi-permanent ease or stretch imparted to the fabric is made substantially permanent.

9. Apparatus according to claim 8 wherein the apparatus is adapted to handle individual strips of fabric.

10. Apparatus according to claim 8 wherein the apparatus includes means for handling continuous reels of fabric.

11. Apparatus according to any of claims wherein the apparatus comprises a rubberized conveyor belt in close proximity to a heated stedel roller, the fabric passing along the belt and being nipped under the roller where both pressure and heat is applied progressively to the whole of the length of the strip or reel as the fabric progresses through the apparatus.

12. Apparatus according to claim 11 wherein a settings for the temperature and pressure of the steel roller, and the speed of the rubberized conveyor belt is pre-selected for one particular run or series of runs, but some or all of these settings can be variable dependent upon the degree of "stretch" required and the nature or composition of the fabric being processed.

13. Apparatus according to claim 8 to wherein the apparatus includes means for optional steaming, water mist or other damping of the fabric prior to the nip to aid the treatment of the fabric.

14. A woven fabric/interlining composite having ease or stretch imparted thereto by the method of claim 1.

15. A waistband incorporating a fabric/interlining composite treated in accordance with the method of claim 1.

* * * * *